US005322739A

United States Patent [19]

Stagl

[11] Patent Number: 5,322,739

[45] Date of Patent: Jun. 21, 1994

[54] TROPHY CONSTRUCTION

[75] Inventor: Peter M. Stagl, Morris Plains, N.J.

[73] Assignee: Avnet, Inc., Great Neck, N.Y.

[21] Appl. No.: 894,050

[22] Filed: Jun. 3, 1992

[51] Int. Cl.[5] ..... G09F 19/00

[52] U.S. Cl. ..... 428/542.4; D11/131

[58] Field of Search ..... 428/542.4; 248/127, 248/158; D11/131, 164

[56] References Cited

U.S. PATENT DOCUMENTS

| | | | |
|---|---|---|---|
| D.280,889 | 10/1985 | Bulone | 428/542.4 X |
| 3,027,670 | 4/1962 | Kramer et al. | 428/542.4 |
| 3,595,727 | 7/1971 | Allen | 428/16 X |
| 3,754,724 | 8/1973 | Osowski | 428/542.4 X |
| 4,230,417 | 10/1980 | Weiss | 428/542.4 X |
| 4,323,630 | 4/1982 | Mackey et al. | D11/131 X |
| 4,708,895 | 11/1987 | Mizusawa | 428/31 |

*Primary Examiner*—Henry F. Epstein
*Attorney, Agent, or Firm*—Darby & Darby

[57] ABSTRACT

A trophy comprises a riser including a mounting surface on which a lid rests, and spaced apart slots formed in the mounting surface. Resilient locking fingers are molded onto the lid. Each finger has, at its free end, an undercut portion and a sloped surface adjacent the undercut portion. The sloped surface of the finger to engages one of the slots in the mounting surface as the finger enters the slot to urge the locking finger away from the slot edge. The undercut portion engages an inner surface of the riser mounting surface when the locking finger is fully inserted into the slot.

11 Claims, 1 Drawing Sheet

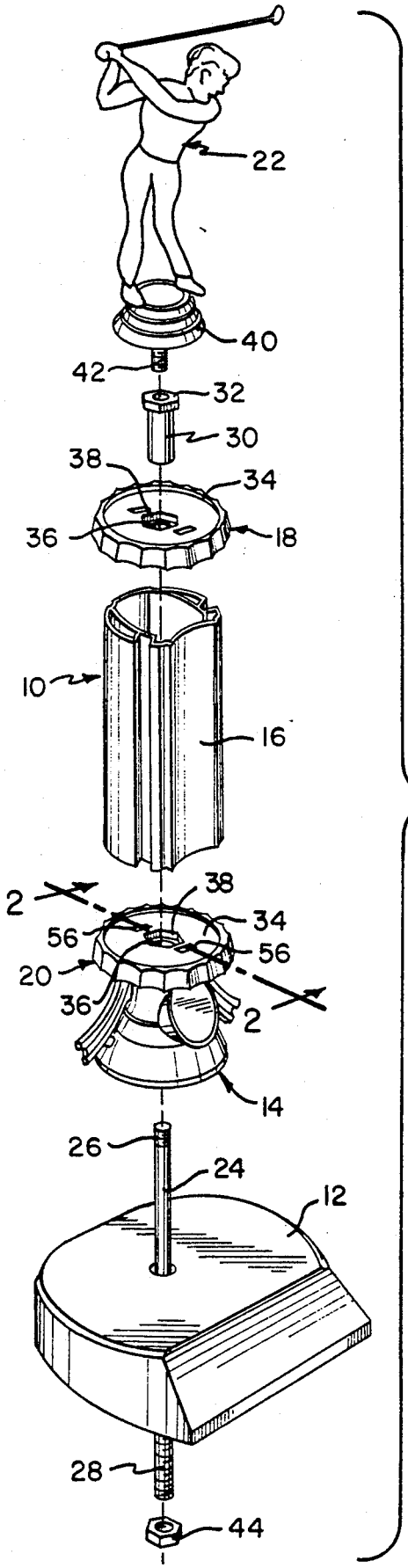
FIG. 1
FIG. 2
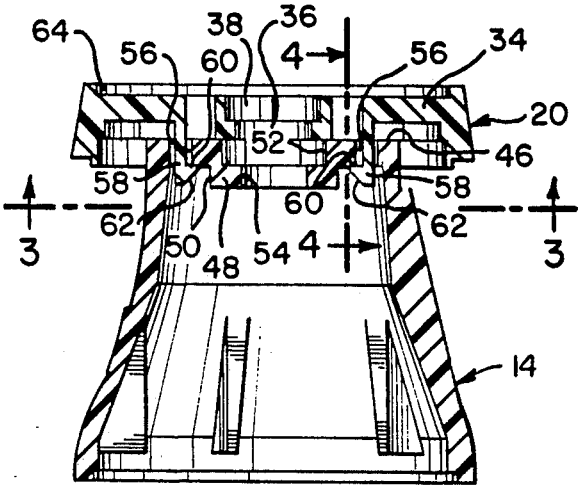
FIG. 4
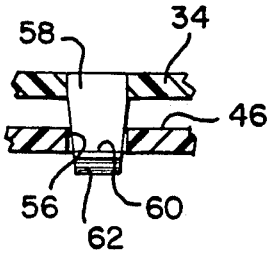
FIG. 3
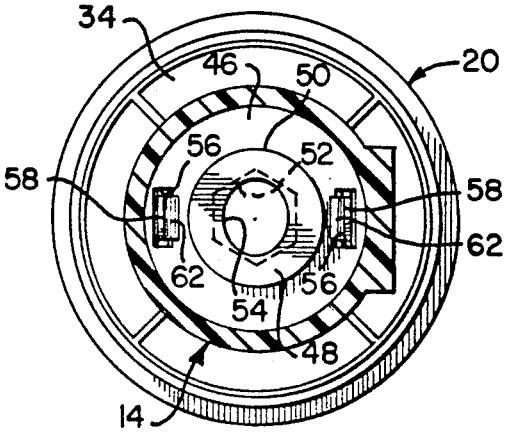

TROPHY CONSTRUCTION

BACKGROUND OF THE INVENTION

The present invention relates to trophy constructions and, more particularly to a trophy construction in which the riser and the lid are molded separately and can be easily secured together.

Inexpensive trophies are conventionally made of extruded and die cast plastic parts. For example, a trophy may comprise a riser or stem secured to a lid or cap adapted to support an elongated decorative extrusion. A similar lid may be secured to the upper surface of the extrusion, and a figurine such as a golfer or other emblem representative of a particular sport, mounted on the upper lid. The trophy construction may be secured to a marble or wooden base by means of a threaded through-rod extending through the entire assembly.

Typically, the riser, lid and figurine are made of vacuum metalized plastic, usually of a gold or silver appearance. The decorative extrusion is also plated attractively to enhance the appearance of the trophy.

In order to give the appearance of quality, fairly complex shapes must be die cast to form a riser and lid(s). For various reasons it is desirable to form the riser and lids separately. For one reason, this gives a dealer or retailer the ability to combine different risers and lids to create different trophies. Secondly, it reduces the cost of the die casting operation which would otherwise require complex dies to form a combined riser and lid.

SUMMARY OF THE INVENTION

The object of the present invention is to provide a simplified trophy construction in which separate risers and die cast lids can be easily and securely connected together.

In accordance with the invention, a trophy comprises a riser including a mounting surface on which a lid rests, and at least two spaced apart slots formed in the mounting surface. At least two resilient locking fingers are molded into the lid. Each finger has, at its free end, an undercut portion and a sloped surface adjacent the undercut portion. The sloped surface of a finger is adapted to engage one of the slots in the mounting surface to urge the locking finger away from the slot edge. The undercut portion is adapted to engage the inner surface of the riser mounting surface when the locking finger is fully inserted into the slot.

In prior art constructions, it was normally necessary to carefully center the lid with respect to the riser. In accordance with the invention, the lid is automatically centered on the riser when it is secured to the riser. A trophy construction according to the invention can be quickly and easily assembled by a dealer or retailer to provide a wide variety of different trophies using only a limited number of parts.

The above-mentioned and other features of the present invention and the manner of attaining the same will become more apparent, and the invention itself will be best understood from the following detailed description of the preferred embodiment of the invention when read with reference to the accompanying drawings.

BRIEF DESCRIPTION OF THE DRAWINGS

FIG. 1 is an exploded perspective view of a toy trophy according to the present invention;

FIG. 2 is a cross-sectional view along line 2—2 of FIG. 1;

FIG. 3 is a cross-sectional view along line 3—3 of FIG. 2; and

FIG. 4 is a partial cross sectional view along line 4—4 of FIG. 2.

DETAILED DESCRIPTION OF THE PREFERRED EMBODIMENT

A trophy 10 according to the invention includes a base 12 for supporting the trophy 10 on a surface, a riser 14 placed on the base 12, a decorative extrusion 16 supported on the riser 14 and mounted between two lids 18 and 20, and a figurine 22 which, in the described embodiment, represents a golfer.

All parts of the trophy 10 in FIG. 1 are held securely together by a rod member 24. In the embodiment shown in FIG. 1, the rod member 24 has opposite upper and lower threaded end portions 26 and 28. A sleeve 30 with an internal thread corresponding to the external thread of end portion 26 extends into the decorative extrusion 16 through an opening 36 in the wall 34 of the upper lid 18 with the head 32 of the sleeve 30 being seated in a recess 38 formed in the wall 34 and having a configuration corresponding to that of the head 32, a hexagonal configuration in the embodiment shown in FIG. 1. The end portion 26 of rod 24 is screwed into the threaded opening of the sleeve 30.

The figurine 22 has a base 40 with a threaded projection 42 which is also screwed into the threaded opening of the sleeve 30 from the head side of the sleeve. The rod member 24 is secured to the base 12 by a nut 44, which can be screwed onto the threaded end portion 28 of the rod member 24 in an appropriate recess (not shown) in the bottom surface of the base 12.

FIG. 2 shows the assembly of the lower lid 20 and the riser 14. The lower lid 20 is identical to the upper lid 18 and the elements of the lower lid 20 will be designated with the same reference numerals as the corresponding elements of the upper lid 18. The riser 14 has a mounting surface 46 having a ring-like projection 48 which defines a shoulder 50. The mounting surface 46 and the ring-like projection 48 have central openings 52 and 54, respectively, through which the rod member 24 extends. The surface 46 has two diametrically opposite preferably rectangular slots 56. Two resilient locking fingers 58 project from the bottom surface 34 of the lid 20. Each of the locking fingers 58 has, at its free end, an undercut portion 60 and adjacent thereto a sloped surface 62 adapted to engage the edge of a respective slot 56.

To assemble the trophy, a selected lid is placed on a selected riser with fingers 58 engaging the slots 56. The sloped surfaces 62 "cam" the fingers apart so that they can be pushed into slots 56. When fully inserted, the resilient fingers return to their illustrated position in which the fingers are locked into the slots. The undercut portions of the fingers 58 engage the mounting surface 46 of the riser 14 to keep the two parts together. The lid 20 has a recess 64 for receiving the extrusion 16.

While particular shapes of the base, the riser, the extrusion and the figurine are disclosed, it should be clear that other shapes can be equally used. Thus, the base, the riser and the lids need not be circular or partially circular, they can be, e.g., square or rectangular.

Accordingly, while a particular embodiment of the invention has been shown and described, various modification thereof will be apparent to those skilled in the art and, therefore, it is not intended that the invention be limited to the disclosed embodiment or to the details thereof, and the departures may be made therefrom within the spirit and scope of the invention as defined in the appended claims.

I claim:

1. A trophy comprising a riser having a mounting surface; a first lid resting on said mounting surface; and a decorative figurine supported above said first lid, said riser and said lid being a plastic material, said mounting surface having at lest two spaced apart slots formed therein, and said first lid having at least two resilient locking fingers of plastic material integrally connected to said lid and adapted to extend into said slots for securing said first lid to said riser, each of said fingers having, at the free end thereof, an undercut portion and a sloped surface formed adjacent to said undercut portion, during insertion of said fingers into said slots, each of said sloped surfaces engaging an edge of a respective slot to urge the associated finger away from the slot edge, and said undercut portion engaging an inner side of said mounting surface of said riser when the finger is fully inserted into the respective slot to thereby securely attach said lid to said riser.

2. A trophy as set forth in claim 1, further comprising a decorative extrusion supported on said first lid, and a second lid resting on an upper surface of said decorative extrusion, said decorative figurine being supported on said second lid.

3. A trophy as set forth in claim 2, further comprising a base for supporting the trophy on a surface, said riser being securely attached to said base.

4. A trophy as set forth in claim 3, further comprising means for detachably connecting said base, said riser, said decorative extrusion and said figurine together.

5. A trophy as set forth in claim 4, wherein said detachably connecting means comprises a rod member engageable with said base and extending through said base, said riser and said decorative extrusion and having a threaded end portion, and thread means associated with said figurine and cooperating with said threaded end portion.

6. A trophy as set forth in claim 5, wherein said thread means includes a sleeve having a threaded opening and extending through said second lid, said threaded end portion of said rod member extending into said threaded opening from one end of said sleeve, said figurine having a threaded projection extending into said threaded opening form another end of said sleeve.

7. A trophy as set forth in claim 5 wherein said slots are positioned symmetrically relative to said rod member.

8. A trophy comprising:

a riser having a mounting surface;

a first lid resting on said mounting surface; and a decorative figurine supported above said first lid, said mounting surface having at least two slots formed therein, and said first lid having at least two resilient locking fingers of plastic material connected directly to said lid and adapted to extend into said slots for securing said lid to said riser, each one of said at least two fingers having, at the free end thereof, an undercut portion and a sloped surface formed adjacent to said undercut portion, said sloped surface engaging an edge of a respective slot to urge the finger away from the slot edge, and said undercut portion engaging an inner side of said riser mounting surface when the finger is fully inserted into the respective slot to thereby secure said first lid to said riser.

9. A trophy as in claim 8, further comprising a decorative extrusion supported on said first lid, a second lid resting on the upper surface of said decorative extrusion, said decorative figurine being supported on said second lid.

10. A trophy as in claim 9, further comprising a base for supporting the trophy on a surface, said riser being attached to said base, and detachable connecting means including a rod member engageable with said base and extending through said base, said riser and said decorative extrusion and having a threaded end portion, and thread means associated with said figurine and cooperating with said threaded end portion.

11. A trophy as in claim 10, wherein said thread means includes a sleeve having a threaded opening and extending through said second lid, said threaded end portion of said rod member extending into said threaded opening at one end of said sleeve, said figurine having a threaded projection extending into said threaded opening at another end of said sleeve.

* * * * *